United States Patent [19]

Kirchner et al.

[11] Patent Number: 4,790,044

[45] Date of Patent: Dec. 13, 1988

[54] PROCESS FOR THE PURIFICATION OF PRODUCTS OF REGENERATED CELLULOSE

[75] Inventors: Hans-Gert Kirchner, Bomlitz; Bernd Wahle, Kaarst, both of Fed. Rep. of Germany

[73] Assignee: Wolff Walsrode AG, Walsrode, Fed. Rep. of Germany

[21] Appl. No.: 916,776

[22] Filed: Oct. 9, 1986

[30] Foreign Application Priority Data

Oct. 12, 1985 [DE] Fed. Rep. of Germany ..... 3536537

[51] Int. Cl.[4] ..... D06B 3/12

[52] U.S. Cl. ..... 8/151; 8/149.1; 68/5 D

[58] Field of Search ..... 8/151, 148, 149.1, 149.3, 8/150; 68/5 D, 19.1, 21, 27, 43, 94, 13 R

[56] References Cited

U.S. PATENT DOCUMENTS

| | | | |
|---|---|---|---|
| 2,916,767 | 12/1959 | Stevens | 8/151 X |
| 3,857,261 | 12/1974 | Wilcox | 68/27 X |
| 3,889,390 | 6/1975 | Klare | 68/18 R X |
| 3,972,209 | 8/1976 | Serkov et al. | 68/22 R |
| 4,004,879 | 1/1977 | Meier-Windhorst et al. | 8/151 X |
| 4,025,304 | 5/1977 | Fleissner | 8/151 |
| 4,103,521 | 8/1978 | Tachibana | 68/13 R |
| 4,372,135 | 2/1983 | Heidan | 68/27 X |
| 4,520,520 | 6/1985 | Johnston | 8/151 |

FOREIGN PATENT DOCUMENTS 7521944 2/1977 France .

*Primary Examiner*—Donald Watkins

*Attorney, Agent, or Firm*—Sprung Horn Kramer & Woods

[57] ABSTRACT

Process for the purification of products of regenerated cellulose in which the regenerated cellulose product is passed through at least one washing segment where it is initially squeezed out with the aid of a squeezing element and then washed out with the washing water, passed in counter current, while simultaneously being deflected over deflection elements.

1 Claim, 1 Drawing Sheet

PROCESS FOR THE PURIFICATION OF PRODUCTS OF REGENERATED CELLULOSE

Figure 1:
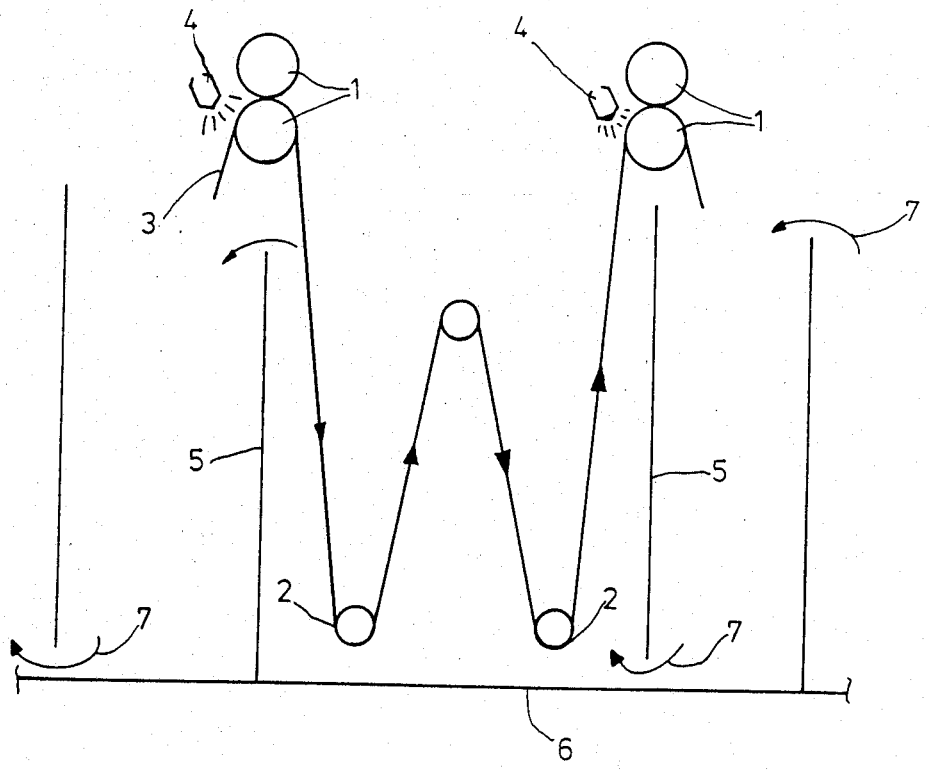

The invention relates to a process for more rapid purification of products of regenerated cellulose, in which the product to be purified passes through at least one washing segment where it is initially squeezed out with the aid of squeezing elements and then washed out over deflection elements with the washing medium, flowing in counter current.

It is known that in customary dry spinning processes, the solid is formed by evaporating the solvent, for example in a drying shaft, whilst in wet spinning processes, the solvent is removed by dilution, rinsing-out, neutralization and the like and the dissolved polymer is thus made to precipitate and is then purified by washing-out.

The coagulation of cellulose xanthogenate, which is caused by neutralization of the sodium hydroxide solution solvent by sulphuric acid, is thus also followed by re-forming of the cellulose by acid hydrolysis (regenerated cellulose). In addition to gaseous compounds, such as hydrogen sulphide and carbon disulphide, considerable amounts of salts, in particular sodium sulphate, are thereby formed and, together with the regenerating agent sulphuric acid and constituents of the precipitating bath, remain in the cellulose and must be removed by subsequent washing.

Complete washing-out of all the concomitant substances is particularly important with cellulose products which, as commodity articles, come into contact with foodstuffs, such as, for example, as packaging film or artificial gut.

Regenerated cellulose products are usually washed out either in a vertical arrangement (vertical washing), in which the continuous webs of material running up and down are sprayed at the top with water, water laden with salt and acid flowing out at the lower deflection points, or in horizontal washing baths (vat washing), which are frequently arranged one on top of the other in several stages, with water in counter current.

Both systems have considerable disadvantages. Purely diffusion-controlled processes take place both in the vertical and in the vat washing. The consequence of this is that the mass transfer initially takes place rapidly at high concentrations of constituents to be washed out and only short washing zones are therefore necessary, whilst as the concentrations decrease, the washing zones must be considerably longer in design because of the low mass transfer. Residues of less than 1 g of salt per 100 g of cellulose can be achieved only with great expenditure.

To achieve the required high degree of washing-out, considerable amounts of energy, water and converted space are therefore necessary, both with vertical and with vat washing.

The aim of the present invention was therefore to provide a more efficient washing-out process for regenerated cellulose products, in order finally thus to achieve an increase in the rate of production.

The present invention thus relates to a process for the purification of products of regenerated cellulose, preferably cellophane film or artificial gut, which is characterized in that the regenerated cellulose product is passed through at least one washing segment where it is initially squeezed out with the aid of a squeezing element and then washed out with the wasing water, passed in counter current, while simultaneously being deflected over deflection elements.

Depending on the desired degree of purity of the cellulose products, these should pass through one or more washing segments, it being possible for the individual washing segments to be combined in a common vessel or for each itself to be arranged in series behind or on top of one another. As shown in FIG. 1, each of these washing segments (6) should be equipped with a squeezing element (1), the linear pressure of which is adjustable by the customary methods (hydraulics, spring pressure and the like). The squeezing element should preferably consist of a pair of rolls, and at least one of the rolls should have an elastic covering. A combination of an upper rigid roll and a lower rubber-covered roll, such as, for example, a combination of an upper roll of stainless steel and a lower roll with a hard rubber covering of medium Shore hardness, is thus advantageously chosen. Each washing segment (6) has at least one deflection element (2), preferably a deflection roll, it being possible for the residence time of the product to be washed out to be increased with the number of deflection elements. The washing water (7) is passed in counter current to the direction in which the product to be washed out (3) runs. In the case of a common vessel for the individual washing segments, this is guaranteed by baffle plates (5).

The squeezing elements (1) can additionally be equipped with fresh water jets (4) on the intake side, these rinsing away the heavily salt-laden water which emerges during squeezing and some of which flows to the product (3).

During the squeezing process, depending on the thickness of the product to be purified, linear pressures of 1 to 1,000N per cm should be applied. The residence time between successive squeezing elements should be adjusted so that the absorbent product reaches a great state of swelling by uptake of fresh water. As is known, the residence time can be controlled by the machine speed, but also by the number of deflection elements, preferably deflection rolls, and the dimensions of the washing segments. The absorbtion rate of the material is, as is known, influenced by the temperature of the washing water. In the case of regenerated cellulose products, preferably materials in the form of webs or tubular casings laid flat, such as synthetic sausage casings, linear pressures of 100 to 500N per cm are preferred. N is the abbreviation for Newtons, according to Hackh's Chemical Dictionary. Because of the high absorbency of these materials, relatively short residence times of less than 10 seconds may be sufficient to achieve the maximum possible uptake of water.

The purification process according to the invention enables degrees of washing which are superior to those of the prior art to be achieved, with a considerable reduction in the size of plants, water and energy requirement. It is furthermore possible thereby considerably to increase the rate of production.

Cellulose tubes which have been prepared in a known manner by coating a fibrous paper, shaped into a tube, with viscose and subsequent coagulation and regeneration in a precipitating bath containing large amounts of salt and acid, are purified in the following examples. The washing segments used in these examples each have three deflection rolls, a base area of 50×50 cm and a height of 75 cm, measured between the lower deflection roll and the squeezing rolls.

EXAMPLE 1

The artificial gut of regenerated cellulose issuing from the prepurification vat and laden with 0.5 to 0.7 g of salt per g of cellulose is pressed off with the first squeezing rolls under a linear pressure of 120N/cm and passes, at a speed of 7.5 m/minute, through five washing segments with a total washing zone of 12.5 m. The water temperature is 40° C. and the throughput is 25 l/minute. At the end of the washing zone, the artificial gut has a residual salt content of, on average, less than 0.001 g of salt per g of cellulose, determined as residue which can still be dissolved out with water.

EXAMPLE 2

An artificial gut of regenerated cellulose with a salt load of 0.8 to 1 g of salt per g of cellulose is purified in five washing segments at a speed of 10 m/minute in accordance with Example 1. The residual salt content after the purification is 0.002 g of salt per g of cellulose.

EXAMPLE 3

An artificial gut of regenerated cellulose is purified in accordance with Example 1 and 2, the water throughput being increased to 60 l/minute. The residual salt content is, on average, 0.0015 g of salt per g of cellulose.

EXAMPLE 4

A gut with a salt load of 1.2 to 1.4 g of salt per g of cellulose is purified at a speed of 15 m/minute in seven washing segments, corresponding to a total washing zone of 17.5 m, in accordance with Example 3. The residual salt content is, on average, 0.0025 g of salt per g of artifical gut.

| Example | machine speed m/minute | washing water throughput l/min | washing water average temperature °C. | washing zone m | washing residence time | number of washing segments | average residual salt contents = g sulphate / g artificial gut |
|---|---|---|---|---|---|---|---|
| 1 | 7.5 | 25 | 40 | 12.5* | 100 seconds | 5 | <0.001 |
| 2 | 10 | 25 | 40 | 12.5* | 75 seconds | 5 | 0.002 |
| 3 | 10 | 60 | 40 | 12.5* | 75 seconds | 5 | 0.0015 |
| 4 | 15 | 60 | 40 | 17.5* | 70 seconds | 7 | 0.0025 |

*at 2.5 m/washing segment, linear pressure: 120 N/cm

We claim:

1. A process for the purification of films of salt-containing regenerated cellulose, comprising passing the film through at least one washing cycle wherein the film is sprayed with water, squeezing the film, passing the film about deflection elements immersed in countercurrently-flowing wash water so as to wash the film, again spraying with water and again squeezing the film, the squeezing linear pressure ranging from about 100 to 500N per cm and the residence time immersed in the countercurrently-flowing wash water being less than about 10 seconds.

* * * * *